United States Patent [19]

Phaal

[11] 4,215,999

[45] Aug. 5, 1980

[54] ABRASIVE COMPACT WITH A CORE OF HIGH RIGIDITY MATERIAL

[76] Inventor: Cornelius Phaal, 14 Robant La., Sandton, Transvaal, South Africa

[21] Appl. No.: 882,812

[22] Filed: Feb. 28, 1978

[30] Foreign Application Priority Data

Mar. 3, 1977 [ZA] South Africa ..... 77/1274

[51] Int. Cl.[2] ..... B24D 3/06

[52] U.S. Cl. ..... 51/295; 51/307; 51/309

[58] Field of Search ..... 51/295, 297, 308, 309

[56] References Cited

U.S. PATENT DOCUMENTS

| | | | |
|---|---|---|---|
| 2,703,750 | 3/1955 | Cotter | 51/293 |
| 3,407,445 | 10/1968 | Strong | 51/307 |
| 3,743,489 | 7/1973 | Wentorf et al. | 51/309 |
| 3,745,623 | 7/1973 | Rocco | 51/309 |
| 3,850,591 | 11/1974 | Wentorf | 51/309 |
| 4,063,909 | 12/1977 | Mitchell | 51/295 |
| 4,128,971 | 12/1978 | Dunnington et al. | 51/309 |

*Primary Examiner*—Donald J. Arnold

*Attorney, Agent, or Firm*—Haseltine, Lake & Waters

[57] ABSTRACT

An abrasive body, typically in the form of a cylinder, comprising an abrasive compact and a core of high rigidity material such as cemented carbide embedded in to the compact, the compact comprising a mass of abrasive particles such as diamond or cubic boron nitride particles, present in an amount of at least 70 percent by volume of the compact, bonded into a hard conglomerate and the body of high rigidity material being located inside the side surface of the compact and extending from the top surface to the bottom surface of the compact.

14 Claims, 1 Drawing Figure

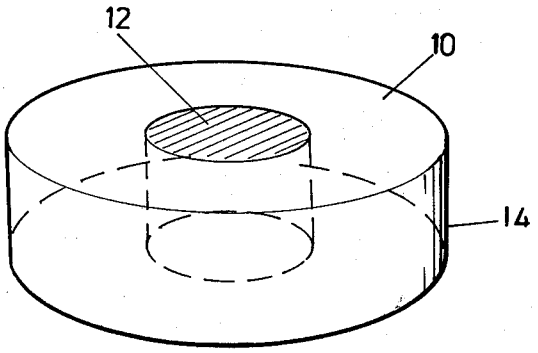
12
10
14

ABRASIVE COMPACT WITH A CORE OF HIGH RIGIDITY MATERIAL

This invention relates to abrasive bodies, and more particularly to abrasive bodies which contain abrasive compacts.

Abrasive compacts are well known in the art and consist essentially of a mass of abrasive particles, generally present in an amount of at least 70%, preferably 80% to 90% by volume of the compact, bonded into a hard conglomerate. Compacts are polycrystalline masses and can replace single large crystals. The abrasive particles of compacts are invariably super-hard abrasives such as diamond and cubic boron nitride.

Abrasive compacts, particularly diamond and cubic boron nitride compacts, may be self bonded, i.e. the individual particles of the compact may be fused and bonded together without the aid of a metal or like bonding matrix. Alternatively, stronger and more durable compacts are produced when there is a suitable bonding matrix present.

In the case of cubic boron nitride compacts, i.e. compacts in which the abrasive particle is predominantly cubic boron nitride, the bonding matrix, when provided, preferably contains a catalyst (also known as a solvent) for cubic boron nitride growth such as aluminum or an alloy of aluminum with nickel, cobalt, iron, manganese or chromium. Such catalysts tend to be soft and to minimize smearing of the catalyst during use of the compact it is preferred that the matrix also include a ceramic such as silicon nitride which is capable of reacting with the catalyst to produce a hard material.

In the case of diamond compacts, i.e. compacts in which the abrasive particle is predominantly diamond, the bonding matrix, when provided, preferably contains a solvent for diamond growth. Suitable solvents are metals of Group VIII of the Periodic Table such as cobalt, nickel or iron or an alloy containing such a metal.

For diamond and cubic boron nitride compacts the presence of a solvent or catalyst for the particular abrasive being used in the compact is desirable because then under the conditions necessary for the manufacture of such compacts intergrowth between the particles occurs. As is known in the art, diamond and cubic boron nitride compacts are generally manufactured under conditions of temperature and pressure at which the abrasive particle is crystallographically stable.

Diamond and cubic boron nitride compacts are used for the machining of metals. In use, the compacts are fastened to a suitable support such as a shank to form a tool. The compacts may be fastened to a backing such as a cemented carbide backing and then the backing fastened to the support to form the tool. Diamond and cubic boron nitride compacts fastened or to a cemented tungsten carbide backing are described and illustrated in U.S. Pat. Nos. 3,743,489 and 3,745,623 and British Pat. No. 1,489,130.

According to the present invention there is provided an abrasive core comprising an abrasive compact and a core of high rigidity material embedded in the compact, the compact comprising a mass of abrasive particles, present in an amount of at least 70 percent by volume of the compact, bonded into a hard conglomerate, the core of high rigidity material being located inside of and extending through the compact. The core of high rigidity material is preferably located substantially in the center of the compact.

In one preferred form of the abrasive body, the compact is cylindrical and the core of high rigidity material is located axially in the compact. An abrasive body having such a configuration may be used, for example, as a bearing surface or as a cutting or grinding wheel. The core of high rigidity material provides the axis for the body and the compact surround provides a hard and durable bearing, cutting or grinding surface.

The high rigidity material may be a hard steel such as a steel of the M or T series.

The preferred high rigidity material is a cemented carbide. Suitable cemented carbides are, for example, cemented tungsten carbide, cemented titanium carbide, cemented tantalum carbide and mixtures thereof. Such carbides, as is known in the art, have a metal bonding matrix usually consisting of cobalt, nickel, iron or a mixture thereof. The metal bonding matrix is usually provided in an amount of 3 to 25 percent by weight of the carbide.

The compact is preferably a diamond or cubic boron nitride compact of the type described above.

The core of high rigidity material may be fastened or bonded to the compact either directly or through a bonding layer. When the high rigidity material is a hard steel then there will generally be direct bonding between the core and the compact. When the high rigidity material is a cemented carbide and the compact is a diamond or cubic boron nitride compact, then the bonding may be direct in the manner described and illustrated in U.S. Pat. Nos. 3,743,489 and 3,745,623 or through an interposed metal or alloy bonding layer such as that illustrated in British Pat. No. 1,489,130.

The size of the abrasive body of the invention will vary according to the application to which it is to be put. In the case of cylindrical compacts the diameter of the compact is typically in the range 5 to 25 mm and the thickness of the compact is typically in the range 1 to 5 mm. The abrasive body of the invention is manufactured in high temperature/high pressure apparatus known in the art. Typical apparatus of this type is the so-called "belt" apparatus of the type illustrated in U.S. Pat. No. 2,941,248. The body is made by placing high rigidity material inside a suitable compact-forming material in the reaction capsule for such an apparatus. The reaction capsule is placed in the apparatus and the contents then exposed to conditions of elevated temperature and pressure suitable to form a compact. Suitable conditions for compact manufacture are known in the art and are described and illustrated in the abovementioned British Patents.

The high rigidity material which is placed in the reaction capsule may be a pre-formed slug or a mass of powder sinterable to form a coherent slug.

The compact-forming material which surrounds the high rigidity material in the reaction capsule will generally comprise a mixture of the abrasive particles for the compact and a suitable powdered matrix. If the compact is to be fastened to the high rigidity material by means of a metal or metal alloy layer, then a layer of such metal or metal alloy, in powder or foil form, is interposed between the high rigidity material and the surrounding compact-forming material.

The invention is further illustrated by the attached drawing which is a perspective view of an abrasive body of the invention.

Referring to this drawing, there is shown an abrasive body consisting of a cylindrical compact 10 and a core 12 of high rigidity material located axially in and in the center of the compact. The core of high rigidity material extends through the compact. As is described above, the core of high rigidity material may be fastened or bonded directly to the compact or through an interposed bonding layer. The outer surface 14 of the body is that of a hard and durable compact and as such provides an excellent bearing, cutting or grinding surface.

In an example of the invention a cylindrical core of cemented tungsten carbide (15% by weight cobalt binder phase) was placed in the reaction capsule of a conventional high temperature/pressure apparatus of the "belt" type described above and surrounded with a mixture of diamond and cobalt powder. The powdered mixture had an average particle size of 40 microns. The diamond was provided in an amount of about 80 percent by weight of the mixture, with the cobalt comprising the remainder of the mixture. The contents of the reaction capsule were than exposed to a temperature of the order of 1600° C. and a pressure of about 55 to 60 kilobars and these elevated conditions maintained for about ten minutes. The temperature and then pressure were allowed to return to ambient and recovered from the reaction capsule using conventional techniques was a diamond compact having a centrally located slug of cemented tungsten carbide. The compact was of a cylindrical shape, having an outer diameter of 10 mm and a thickness or length of 4.0 mm. The cemented tungsten carbide was machined away and this left a cylindrical compact, having a centrally located hole, which was useful as a bearing surface.

I claim:

1. An abrasive body comprising an abrasive compact having a top surface and a bottom surface joined by one or more side surfaces and comprising a mass of diamond or cubic boron nitride abrasive particles, present in an amount of at least 70 percent by volume of the compact, bonded into a hard conglomerate; and a core of high rigidity material selected from the group consisting of steel and cemented metal carbides embedded in the compact and being located inside the side surface or surfaces and extending from the top surface to the bottom surface of the compact.

2. An abrasive body according to claim 1 wherein the core of high rigidity material is located substantially in the center of the compact.

3. An abrasive body according to claim 1 wherein the compact is cylindrical and the core of high rigidity material is located axially in the compact.

4. An abrasive body according to claim 1 wherein the high rigidity material is a steel of the M or T series.

5. An abrasive body according to claim 1 wherein the high rigidity material is a cemented carbide.

6. An abrasive body according to claim 5 wherein the cemented carbide is cemented tungsten carbide, cemented titanium carbide, cemented tantalum carbide or a mixture thereof.

7. An abrasive body according to claim 6 wherein the metal bonding matrix for the cemented carbide is cobalt, nickel, iron or a mixture thereof.

8. An abrasive body according to claim 7 wherein the metal bonding matrix is present in an amount of 3 to 25 percent by weight of the carbide.

9. An abrasive body according to claim 1 wherein the abrasive compact is a cubic boron nitride compact.

10. An abrasive body according to claim 9 wherein the compact includes a matrix which contains a catalyst for cubic boron nitride growth.

11. An abrasive body according to claim 10 wherein the catalyst is aluminum or an aluminum alloy.

12. An abrasive body according to claim 1 wherein the compact is a diamond compact.

13. An abrasive body according to claim 12 wherein the compact includes a matrix which contains a solvent for diamond growth.

14. An abrasive body according to claim 13 wherein the solvent is cobalt.

* * * * *